United States Patent [19]

Mizutani et al.

[11] Patent Number: 4,705,384

[45] Date of Patent: Nov. 10, 1987

[54] IMAGE FORMING APPARATUS WITH LOCKING MEANS

[75] Inventors: Morikazu Mizutani, Tokyo; Shigeyoshi Onoda, Yokohama; Shinji Kanemitsu, Ichikawa, all of Japan

[73] Assignee: Canon Kabushiki Kaisha, Tokyo, Japan

[21] Appl. No.: 797,491

[22] Filed: Nov. 13, 1985

[30] Foreign Application Priority Data

Nov. 15, 1984 [JP] Japan ..... 59-242156

[51] Int. Cl.[4] ..... G03G 21/00

[52] U.S. Cl. ..... 355/3 R; 292/108; 292/210

[58] Field of Search ..... 355/3 R, 3 DR, 3 SH; 292/108, 210

[56] References Cited

U.S. PATENT DOCUMENTS 4,346,924 8/1982 Herriott ..... 292/106 X 4,538,896 9/1985 Tajima et al. ..... 355/3 R 4,542,976 9/1985 Kasamura ..... 355/3 DR

*Primary Examiner*—R. L. Moses

*Attorney, Agent, or Firm*—Fitzpatrick, Cella, Harper & Scinto

[57] ABSTRACT

An image forming apparatus which may be portable wherein the apparatus is divisible into plural parts or wherein it is openable. The apparatus is provided with a latch which can take a latching position for preventing the dividing or opening of the apparatus and a releasing position for allowing the apparatus to be divided or opened. The latch shifts between the positions depending on the posture of the apparatus. When the apparatus takes its horizontal posture wherein it is operable for image formation, the latch is released to allow the apparatus to be opened. When the apparatus is placed or carried in an upright position, the latch is prevented from taking its releasing position, thus preventing the apparatus from being divided or opened erroneously.

15 Claims, 17 Drawing Figures

IMAGE FORMING APPARATUS WITH LOCKING MEANS

FIELD OF THE INVENTION AND RELATED ART

The present invention relates to an image forming apparatus with locking means, more particularly, to a portable image forming apparatus which is divisible into two parts.

A small size image forming apparatus such as an electrophotographic copying apparatus, more particularly, a small size copying machine for personal use, requires that it occupy a minimum amount of and that it is easily carried about.

However, the conventional copying machines require at least the area corresponding to the size of the original to be copied irrespective of whether it is of a stationary original carriage type or of a movable original carriage type. Therefore, it is possible to reduce the height thereof, but it has been difficult to reduce the area occupied thereby. Also, it is difficult to conveniently transport the conventional copying machine even with the height reduction.

In view of this, a portable type copying machine has been proposed as in U.S. Pat. No. 4,465,359 wherein the copying machine is upright when it is not used or when it is carried, so that it can be handled with one hand.

On the other hand, in order to make it easy to dispose of jamming of paper or the like, a divisible or openable copying machine wherein the upper part thereof is pivotably openable may be provided. In this type of copying machine, if the part thereof is opened when it is placed in an upright position, but in advertently contacting an opening lever or the like, it can fall, or the internal part of the machine be damaged. These problems are, of course, not desirable.

SUMMARY OF THE INVENTION

Accordingly, it is a principal object of the present invention to provide an image forming apparatus provided with means for preventing it from opening when it should not be opened.

It is another object of the present invention to provide an image forming apparatus having latching means for preventing the machine from being opened, with a locking means for locking the latching means when the machine is in its upright position, when a grip for carrying is gripped, or when a tray is folded or accommodated, thereby avoiding opening the machine erroneously.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1A:
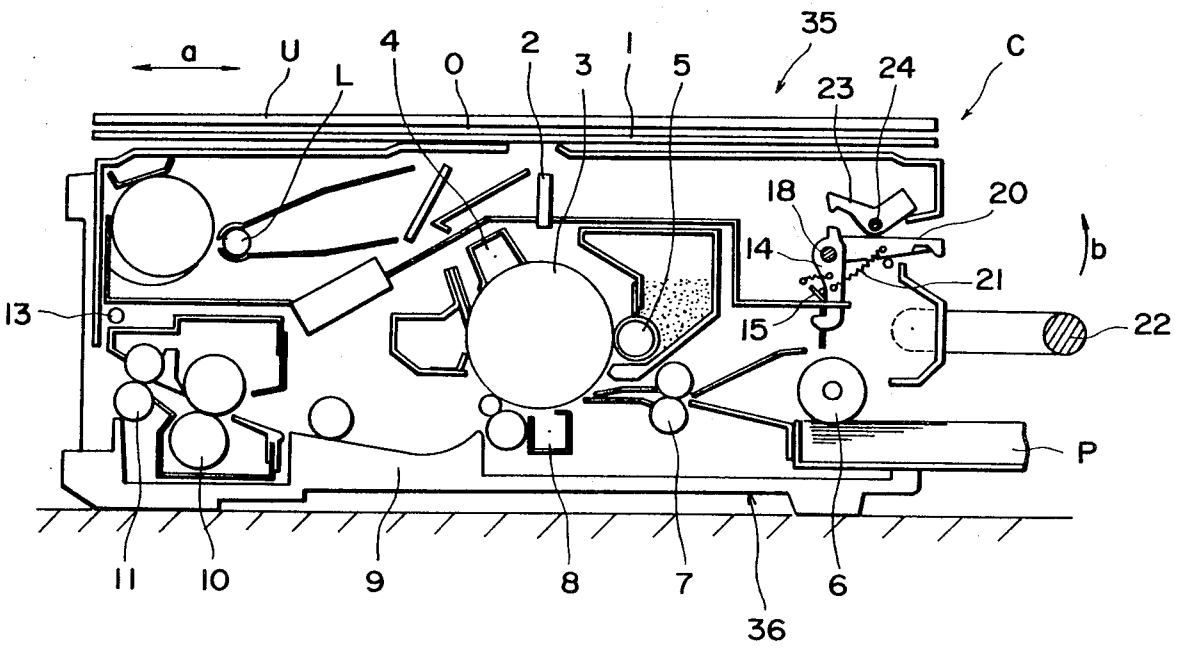
FIG. 1A is a sectional view of a copying machine according to an embodiment of the present invention.

Referring to FIG. 1, there is shown a copying machine according to an embodiment of the present invention. The copying machine in this embodiment comprises an original carriage 1 made of a transparent member of glass or the like for carrying an original to be copied. The original carriage 1 receives a driving force from an unshown motor to slide on an unshown rails in an direction indicated by an arrow a. The machine further comprises an array of small diameter imaging elements each having a small focal length for slit-exposing a photosensitive drum 3 to the image of the light reflected by the original O to be copied illuminated by an illumination lamp L. A charger 4 uniformly charges the photosensitive drum 3. In operation, the photosensitive drum 3 is uniformly charged and then exposed to the image light through the array 2 of the imaging elements so that an electrostatic latent image is formed. The electrostatic latent image is visualized by a developing device 5. On the other hand, an image transfer paper P is fed to the photosensitive drum 3 by a pick-up roller 6 and registration rollers 7 operable to feed the transfer paper P to the photosensitive drum 3 in alignment with the image formed on the photosensitive drum 3. Subsequently, the toner image is transferred from the photosensitive drum 3 onto the transfer paper P by a transfer charger 8. The transfer paper P separated from the drum 3 is conveyed through a guide 9 to an image fixing device 10, where the toner image is fixed on the transfer paper P. The transfer paper is then discharged by discharging rollers 11 to a tray. Designated by a reference U is a member for pressing an original to be copied onto the original carriage 1.

Figure 2:
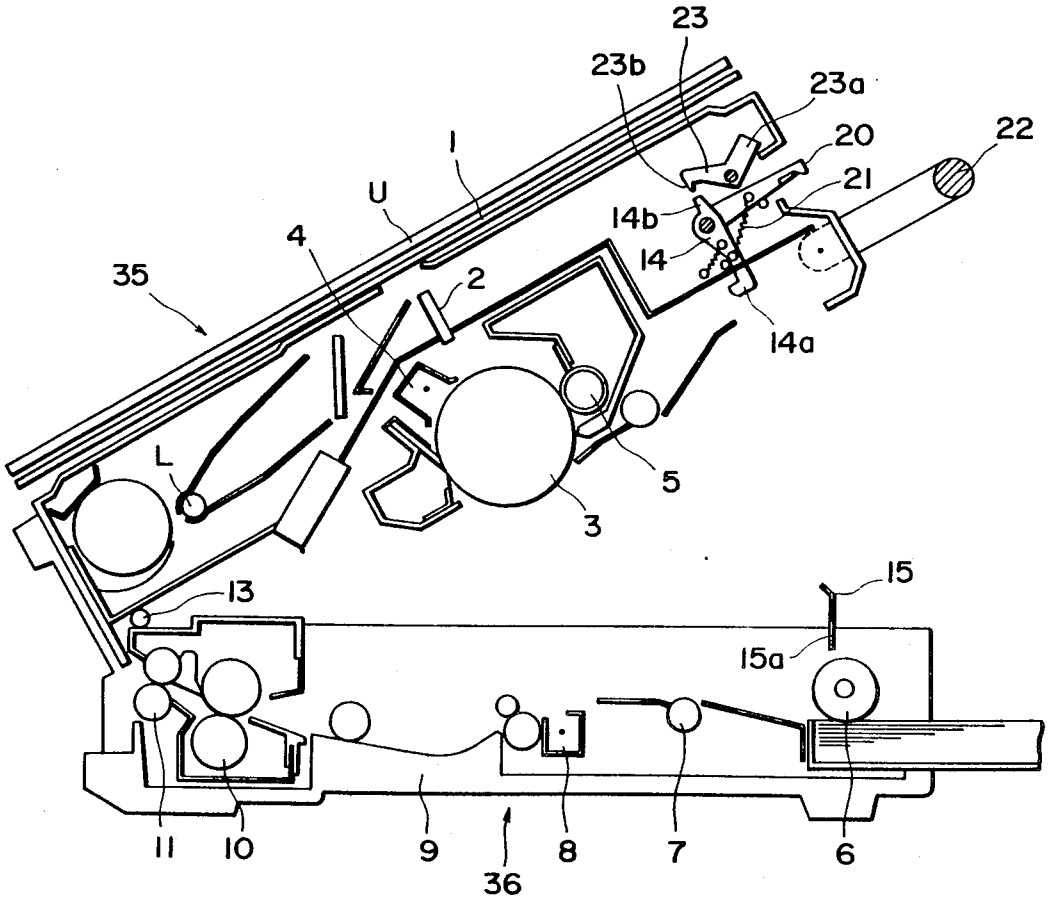
FIG. 2 is a sectional view of the copying machine of FIG. 1A wherein a first part and second part thereof are divided.

The copying machine in this embodiment is separable into an upper unit 35 and a lower unit 36 as shown in FIG. 2. The upper unit 35 is pivotable about a shaft 13 with respect to the lower unit in a direction indicated by an arrow b. The upper unit 35 is normally urged for upward rotation by a torsion spring or the like.

Figure 1B:
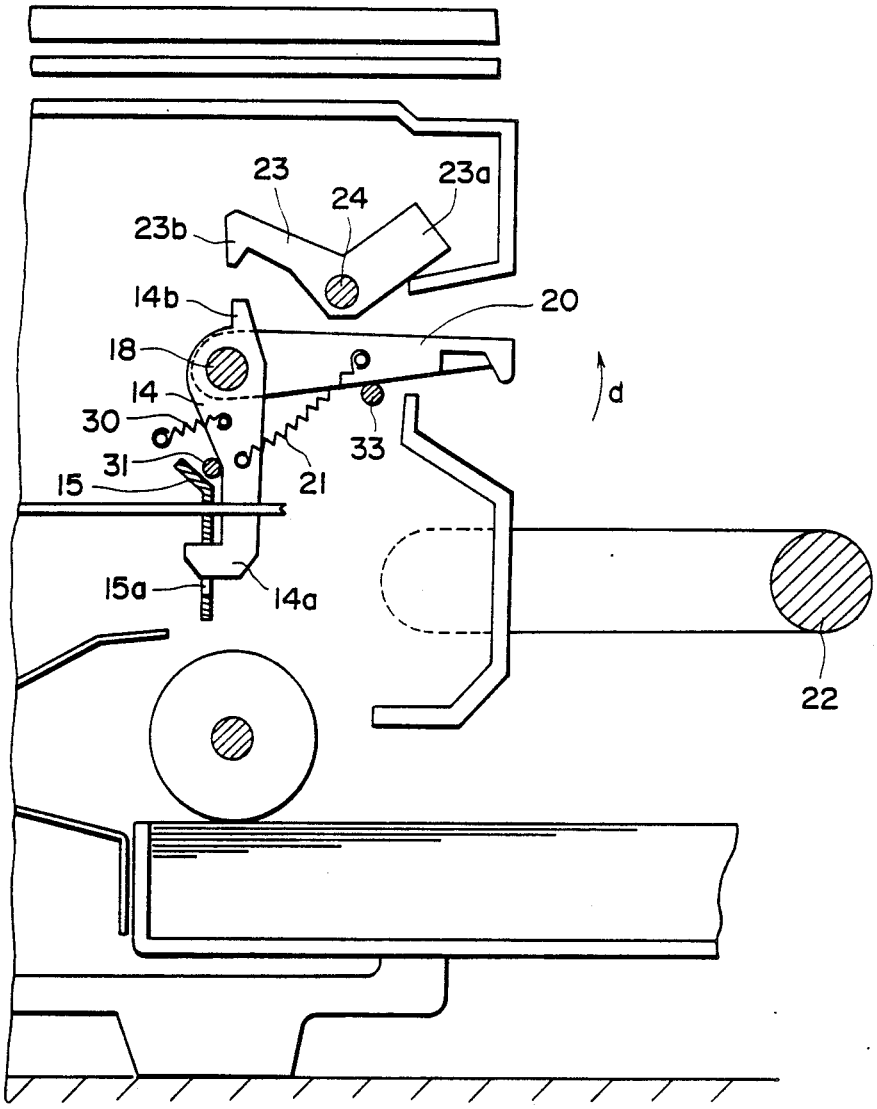
FIG. 1B is an enlarged sectional view of a major part with which the present invention is concerned.

The machine of this embodiment according to the present invention, further includes a hook 14 constituting a part of latching means is provided with a hook portion 14*a* which is engageable with an aperture 15*a* formed in a plate 15 fixed to a frame of the lower unit 36. It is effective to keep the upper and lower unit in a closed position against the torsion spring (FIG. 1) when the hook portion 14*a* is engaged with the aperture 15*a*. That is, the hook 14 is in a latching position wherein the upper unit is not openable. This position is kept by being engaged to a stopper 31 by a spring 30. The hook 14 is fixed to a shaft 18 which is rotatably supported on the upper unit 35. The machine is further provided with an opening lever 20 which is supported rotatably on the shaft 18. When the opening lever 20 is pivoted upwardly in the direction of an arrow d, the movement of the lever 20 is transmitted to the hook 14 through a spring 21, so that the hook 14 pivots in the direction of the arrow d. Then, the hook portion 14*a* is disengaged from the aperture 15*a* of the lower unit, so that the upper unit 35 pivots upwardly by the torsion spring (FIG. 2). The machine is equipped with a grip 22 for carrying the machine. When the machine is carried about or it is put away, the machine is upright with the grip in the top. The opening lever 20 is urged to a stopper 33 by the spring 21. A locking member 23 for releasably locking the hook 14. The locking member 23 is rotatably supported on a shaft 24 fixedly mounted on the upper shaft 35. When the machine C is placed horizontally as shown in FIGS. 1A and 1B, the locking member receives a clockwise moment about the shaft 24 by the weight of a part 23*a* of the locking member 23, whereby a pawl portion 14*b* of the hook 14 is kept disengaged from a hook portion 23*b* of the locking member 23. In other words, the locking member 23 does not act on the hook 14 so as not to interfere the movement of the hook 14.

Figure 3:
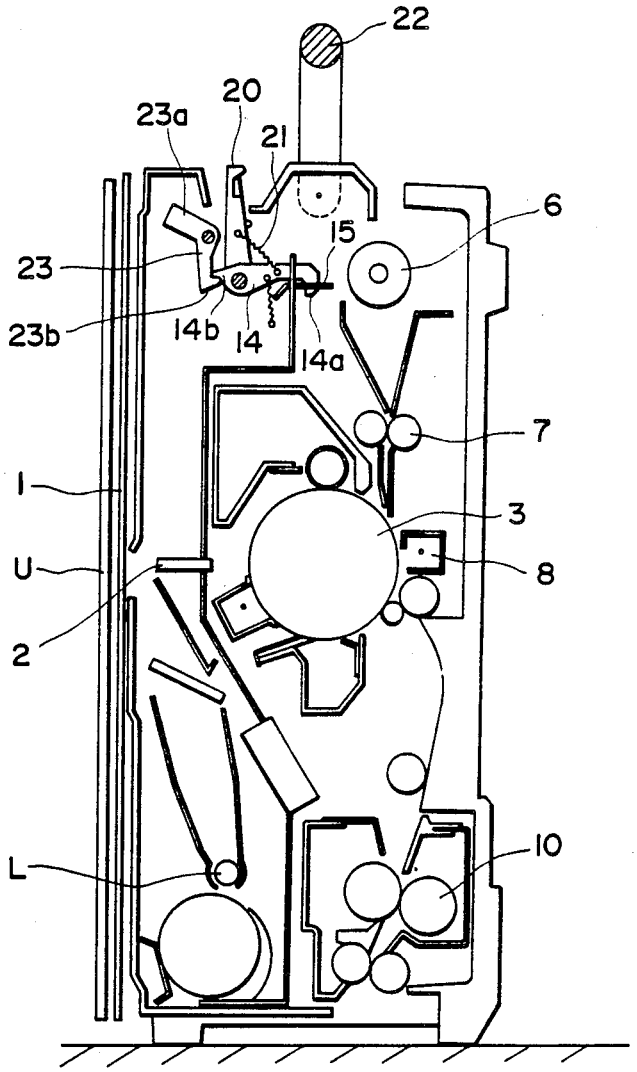
FIG. 3 is a sectional view of the copying machine of FIG. 1A when it is placed upright.

When the machine C is upright as shown in FIG. 3, the weight portion 23*a* of the locking member 23 exerts a counterclockwise moment about the shaft 24 to the locking member 23 by its own weight, so that the hook portion 23*b* engages with the pawl 14*b* of the hook 14. This locks the opening lever 20, because the counterclockwise rotation of the hook 14 is prevented by the locking member 23. The opening lever 24 itself is movable because of the spring 21, but it is not able to pivot the hook 14, with the result that the hook portion 14*a* of the hook 14 is not disengaged from the aperture 15*a* of the plate 15. In this manner, the upper unit is prevented from pivoting about the shaft 13 away from the lower unit 36.

Figure 4A:
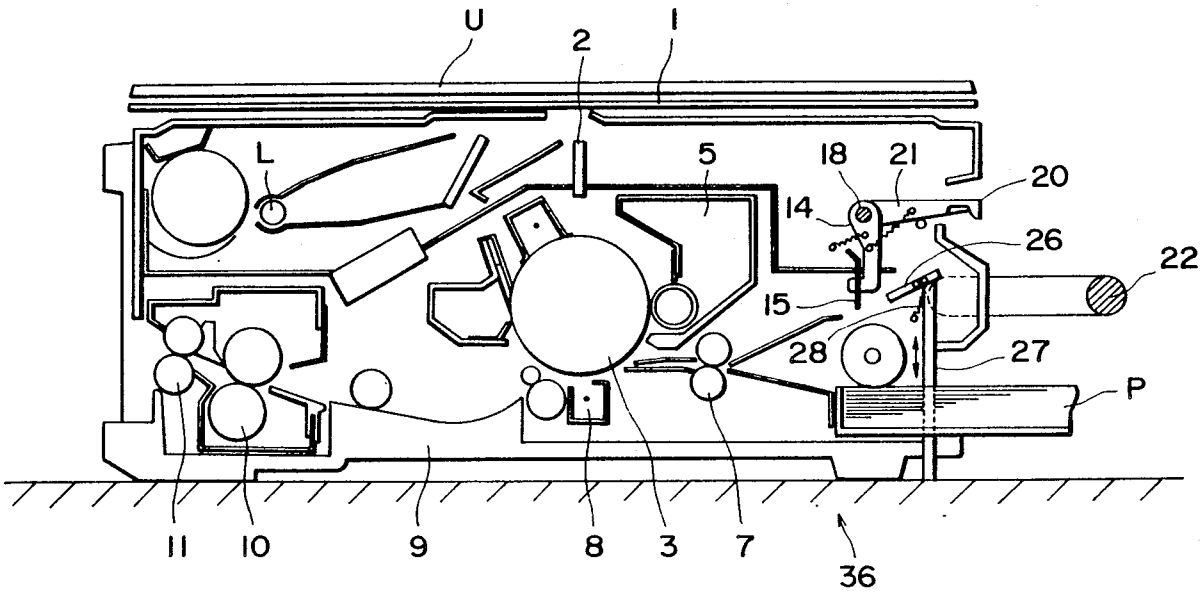
FIG. 4A is a sectional view of a copying machine according to another embodiment of the present invention.
Figure 4B:
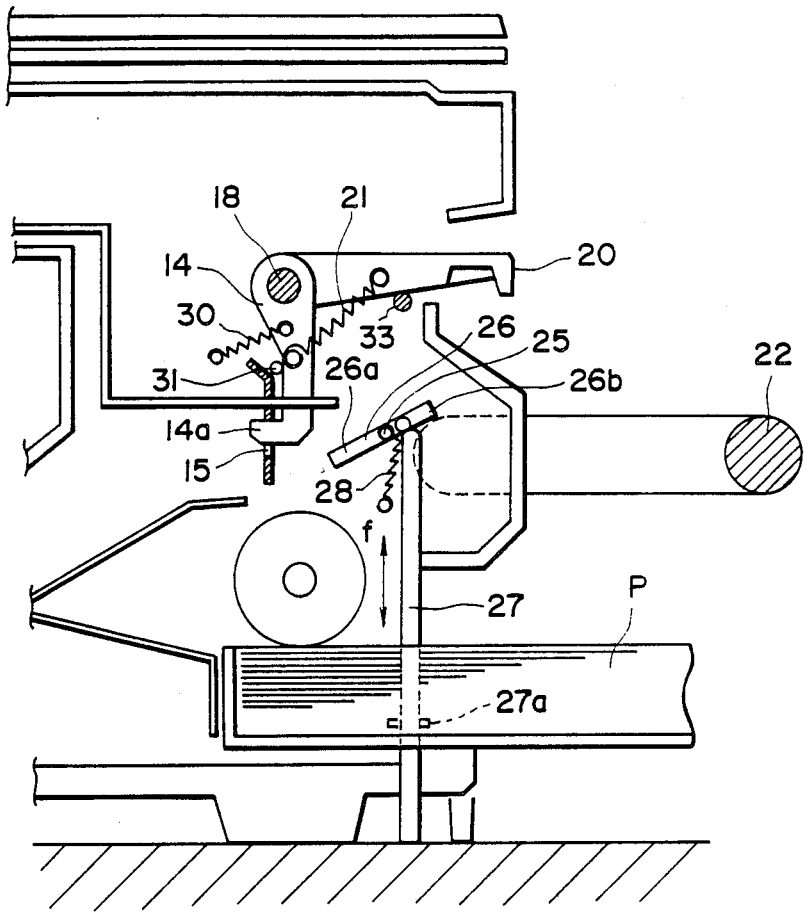
FIG. 4B is a sectioal view of a major part of the copying machine of FIG. 4A with which the present invention is concerned.
Figure 5:
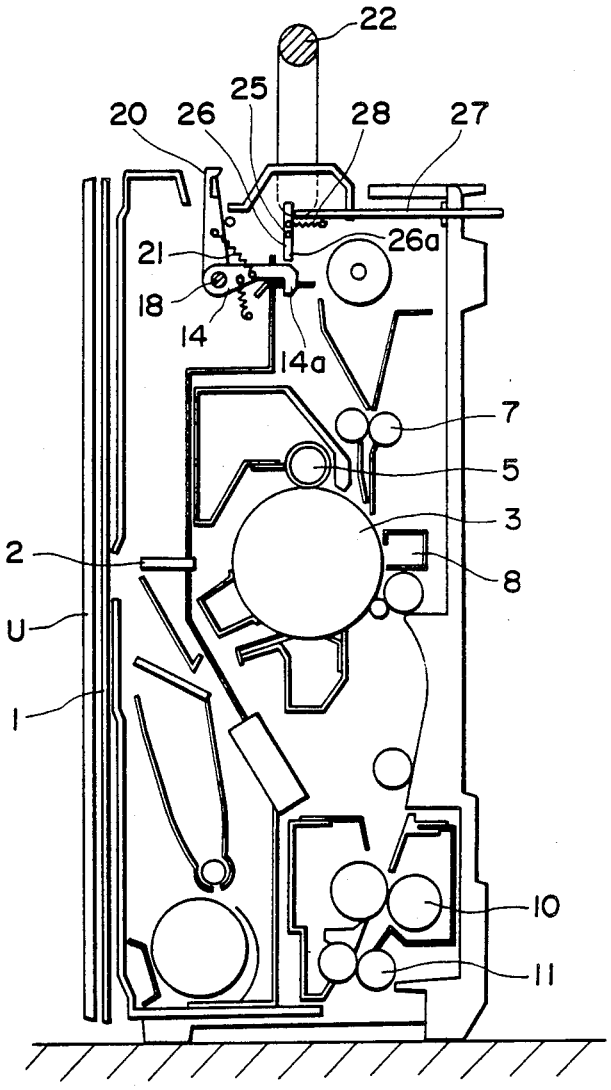
FIG. 5 is a sectional view of the copying machine of FIG. 4A wherein it is placed upright.

FIGS. 4A, 4B and 5 illustrate a copying machine which is an exemplary image forming apparatus according to the present invention.

In FIG. 4A the apparatus is shown as being placed horizontally, whereas it is shown as being upright in FIG. 5. Since this embodiment is similar to the embodiment of FIG. 1A except for the portions which will be described hereinafter, the detailed explanation of the similar parts will be omitted for the sake of simplicity by assigning the same reference numerals or characters to the corresponding elements.

The copying machine includes a hook 14 which is the same as the hook 14 of FIG. 1A embodiment with the exception that it does not have the pawl portion 14*b*. Therefore, the detailed description of the hook 14 will be omitted.

A locking member 26 is rotatably supported on a shaft 26 which is fixed on the lower unit 36. When the machine is upright (FIG. 5), the locking member 26 takes a clockwisely rotated position by a spring 28, wherein an end 26*a* thereof is engaged with the hook 14 to prevent rotation of the hook 14. The opening lever 20 which is interrelated with the hook 14 in the same manner as with the FIG. 1A embodiment is not able to allow the upper part 35 to open away from the lower part.

When, on the other hand, the machine is placed horizontally (FIG. 4A), a lever 27 which is mounted in the lower unit 36 for reciprocal movement in a direction of an arrow f is moved by a table or floor on which the machine is placed. The lever 23 pushes another end 26*b* of the locking member 26 against a spring 28 so as to rotate the locking member 26 in the counterclockwise direction. As a result, the end 26*a* of the locking member 26 is away from a position where it is engaged with the hook 14, thus allowing the hook 14 to rotate in a counterclockwise direction. Therefore, when the lever 20 is pivoted upward, the hook portion 14*a* is disengaged from the uperture 15*a* of the plate 15, thus permitting the upper unit 35 to pivot away from the lower unit 36, thus opening the machine. Designated by a reference 27*a* is a stop pin for preventing the lever 27 to fall.

This embodiment may be modified by moving the members 23 and 26 by a combination of a microswitch effective to sense a horizontal state and a plunger or rotary solenoid. The rotation of the lever 20, in place of the hook 14, may be prevented from rotating.

Figure 6:
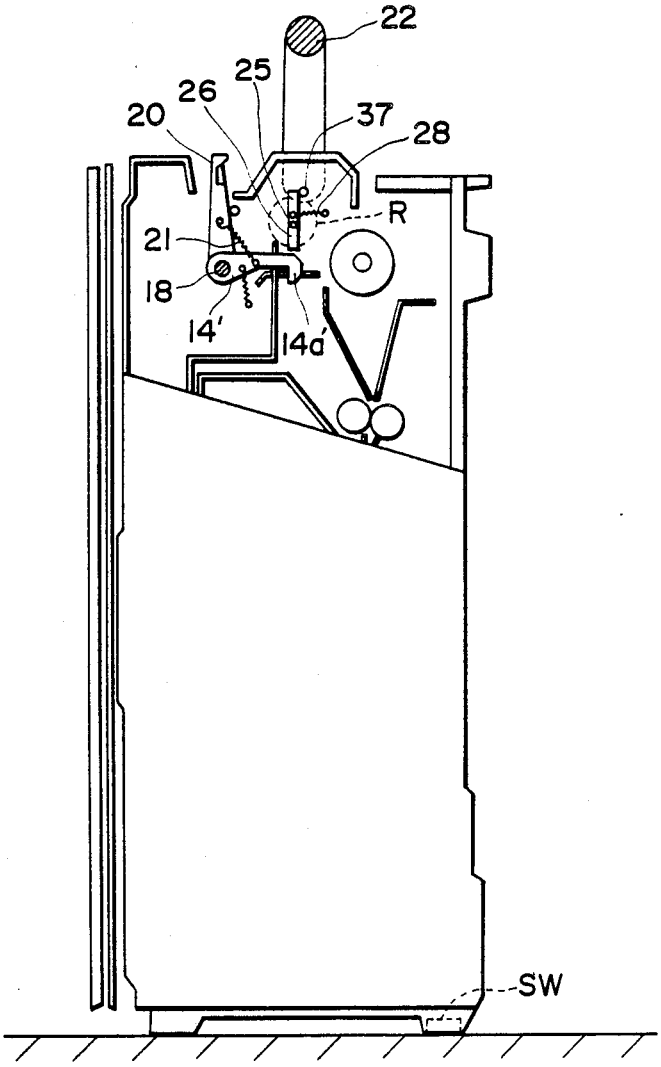
FIG. 6 is a partly sectional view of a copying machine according to a further embodiment of the present invention.

FIG. 6 illustrates another embodiment based on such a modification. The locking member 26 is controlled by a rotary solenoid R when the machine is placed uprightly, a microswitch SW is deactivated so that the locking member 26 is in the position shown in FIG. 6 by a force of a spring 28. At this time, the locking member is engaged to a stopper 37. When the machine is placed horizontally, the switch SW is actuated so as to energize the rotary solenoid R to rotate the locking member 26 against the force of the spring 28 to rotate in the counterclockwise direction. This moves the locking member 26 away from the movable range of the hook 14. By this arrangement, the machine is prevented from opening when it is in the upright position, while it is allowed to open when it is in the horizontal position.

In the foregoing embodiments, the locking member changes its position depending on the posture of the machine. The embodiments which will be described in the following paragraphs change the position of the locking means depending on whether a part of the machine is in its operable position or not.

Figure 7B:
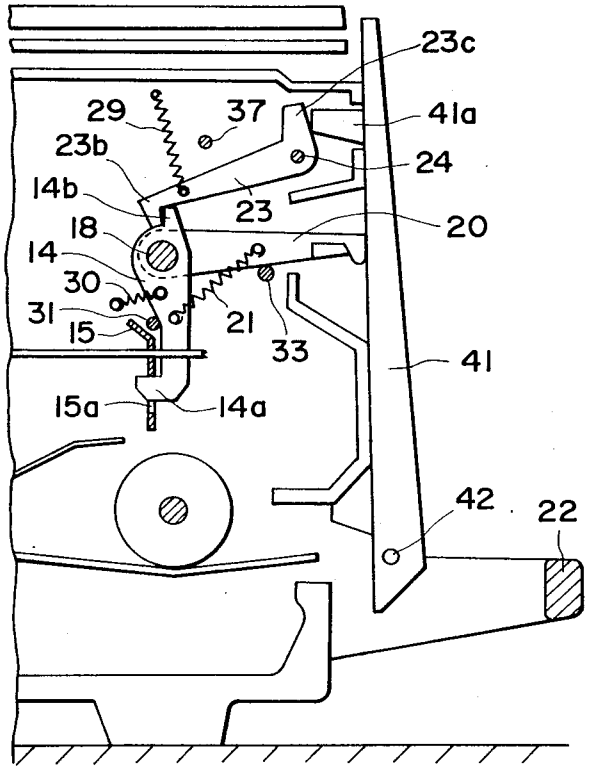
FIG. 7B is a sectional view of the copying machine of FIG. 7A in which a tray is in a folded position.
Figure 7A:
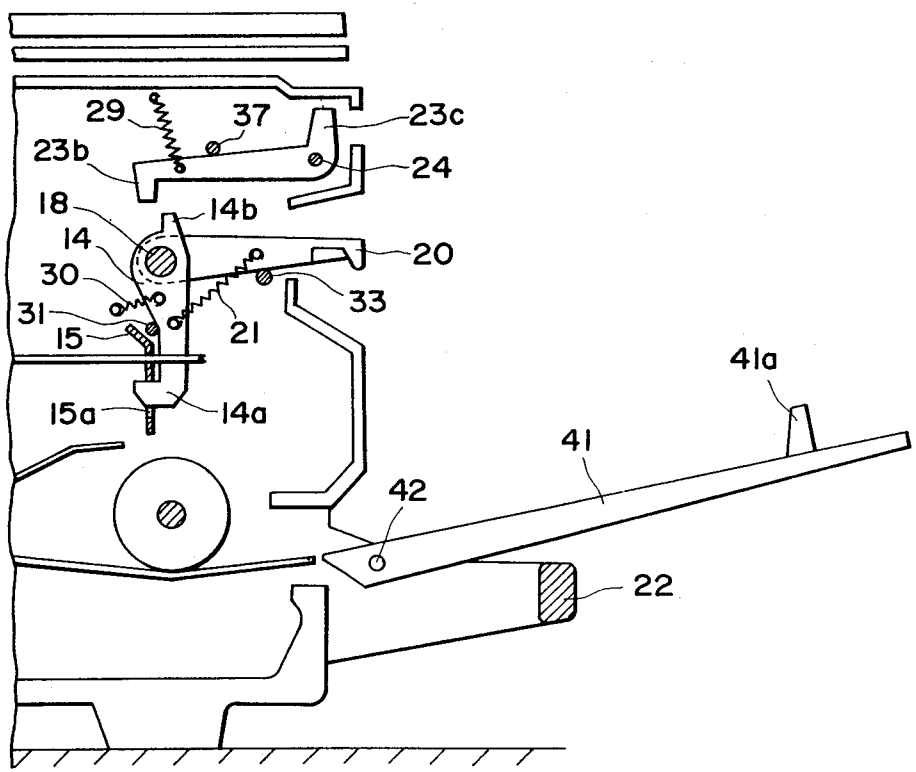
FIG. 7A is a sectional view of a major part of a copying machine with which the present invention is concerned, according to a further embodiment of the present invention.

FIGS. 7A and 7B illustrate a further embodiment of the present invention, wherein a locking member 23 is controlled by a paper feeding tray 41 which is the part of the machine. Since this embodiment is similar to the embodiment of FIG. 1A except for the portions which will be described hereinafter, the detailed explanation of the similar parts will be omitted for the sake of simplicity by assigning the same reference numerals or characters to the corresponding elements.

The paper feeding tray 41 has pins 42 fixed thereto or integral therewith and mounted to the lower unit 36 for rotation by the pins 42. When the machine is not operated or is carried about, the tray 41 may be folded as shown in FIG. 7B.

The machine has a locking member 23 having an end 23*c* which can be acted on by a projection 41*a* of the paper feed tray 41. When the paper feed tray 41 is in the unfolded position to effect guiding of the transfer paper as shown in FIG. 7A, the projection 41*a* of the tray 41 is away from the end 23*c* of the locking member 23. In this state, the locking member 24 is urged by a spring 29 about a shaft 24 in the clockwise direction so as to be engaged to a stopper 37. A hook portion 23*b* of the locking member 23 does not engage with the pawl portion 14*b* of the lock 14, so that the locking member 23 does not prevent the movement of the hook 14 from its latching position to the releasing position.

When the tray 14 is folded for the purpose of carrying the machine, for example, the projection 41*a* of the tray 41 abuts to and pushes the end 23*c* of the locking member 23 to rotate the locking member 23 in the counterclockwise direction about the shaft 24. Then, the hook portion 23*b* of the locking member 23 is engaged with the pawl portion 14*b* of the hook 14, whereby the counterclockwise rotation of the hook 14 is prevented by the locking member 23 so as to prevent the hook portion 14*a* of the hook 14 from disengaging from the aperture 15*a* of the plate 15 even when the lever 20 is rotated. In this manner, the opening of the machine is prevented. The locking member 23 is in the locking position wherein it prevents the hook 14 from moving from its latching position to its releasing position.

Figure 8B:
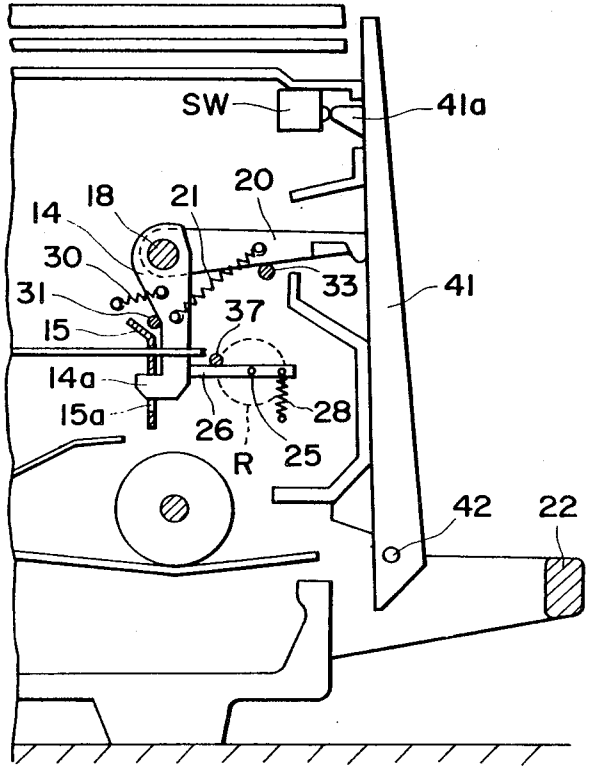
FIG. 8B is a sectional view of the major part of the copying machine of FIG. 8A, wherein a tray is folded.
Figure 8A:
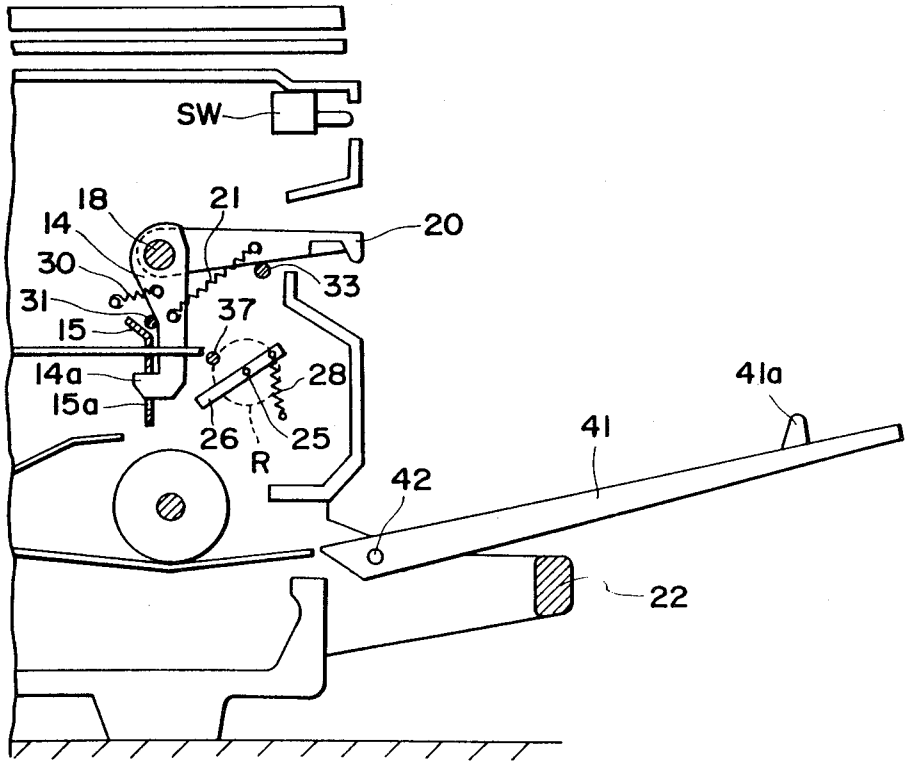
FIG. 8A is a sectional view of a major part of a copying machine according to a further embodiment of the present invention.

FIGS. 8A and 8B illustrate a further embodiment of the present invention, wherein a locking member is switched using a part of the apparatus. Since this embodiment is similar to the embodiment of FIG. 7A the detailed explanation of the similar parts will be omitted by assigning the same reference numerals or characters to the corresponding elements. In FIG. 8A, the machine is in its operative position, and the paper feeding tray 41 is unfolded to effect its paper feeding operation. A switch SW is provided which is actuated when the machine is stated as shown in FIG. 8A. The machine includes a rotary solenoid R which is actuated when the switch SW is actuated, whereby a locking member 26 is rotated in the counterclockwise direction about the shaft 25 against a force of a spring 28. In this position, the locking member 26 does not prevent the hook 14 from switching from its locking position to its releasing position.

When the tray 41 is folded as shown in FIG. 8B, the projection 41*a* of the tray 41 acts on the switch SW to render it "off". In response thereto, the rotary solenoid R is deenergized, the locking member 26 is rotated to abut the stopper 37 by the force of the spring 28. In this state, the hook 14 can not shift to its releasing position. In other words, the locking member 26 is in its locking position wherein the shifting of the hook 14 from its latching position to the releasing position is prevented. In this embodiment, when the tray 41 is unfolded, that is, it is in the operative position, the grip 22 is hindered by the tray 41. Therefore, when the machine is to be carried, it is necessary to hold the tray 41 beforehand, thus preventing the machine from being erroneously opened.

Figure 9:
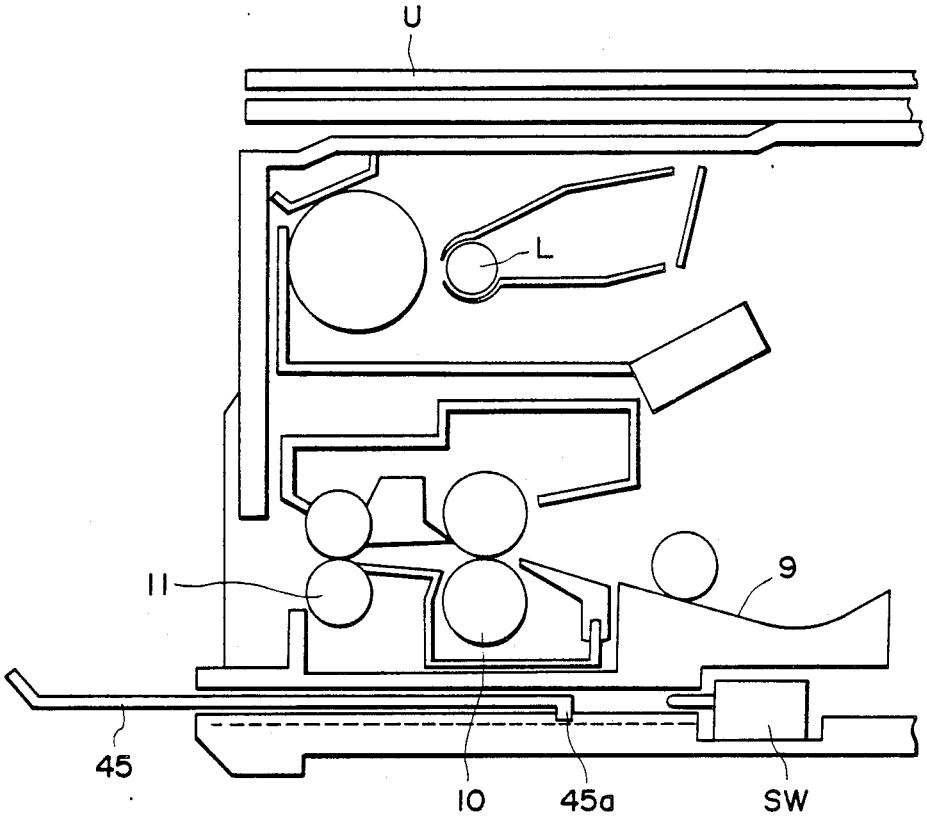
FIG. 9 is a sectional view of a major part of the copying apparatus according to a further embodiment of the present invention.

FIG. 9 shows a further embodiment of the present invention. This invention is similar to the previous embodiment in that a tray is utilized as a part of the machine for shifting the locking member, but is different therefrom in that a sliding type tray is used. FIG. 9 is a sectional view of the machine according to this embodiment, wherein its paper discharging portion is shown. The transfer paper is introduced through a guide 9, and discharged by discharging rollers 11 onto a discharge tray 45. When the machine is to be operated, the discharge tray 45 is drawn out (in the leftward direction) to guide the discharged paper. The discharge tray 45 has an end 45*a* which is able to actuate a switch SW provided in the lower unit 36 of the machine. The switch SW is in the "on" state when no actuated by the end 45*a* of the discharge tray 45. When the machine is to be carried about, for example, the discharge tray 45 is slid in the rightward direction in this Figure and accommodated in the lower unit 36 of the machine. At this time, the end 45*a* actuates the switch SW to render it "off". The switch SW corresponds to the switch SW of the FIG. 8A embodiment. Although not shown, the machine of this embodiment is provided with the locking member 26, the rotary solenoid R or the element therearound. Therefore, when the discharge tray is accommodated in the lower unit 36, the locking member 26 is effective to prevent the shifting of the hook 14 from its latching position to its releasing position. The situation of the rotary solenoid R, the locking member 26 and the hook 14 when the switch is "on", is the same as with the FIG. 8A embodiment when its switch SW is "on".

Figure 10B:
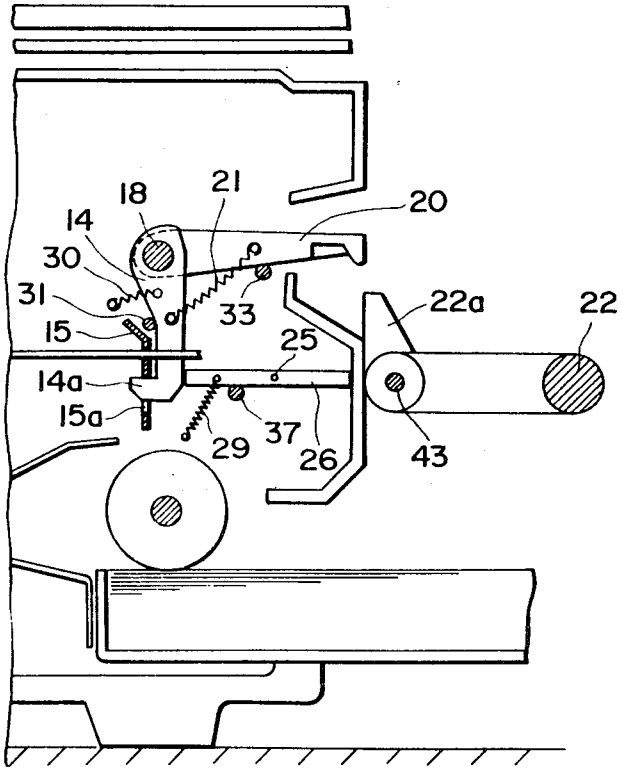
FIG. 10B is a sectional view of the copying machine of FIG. 10A, wherein a grip takes a different position.
Figure 10A:
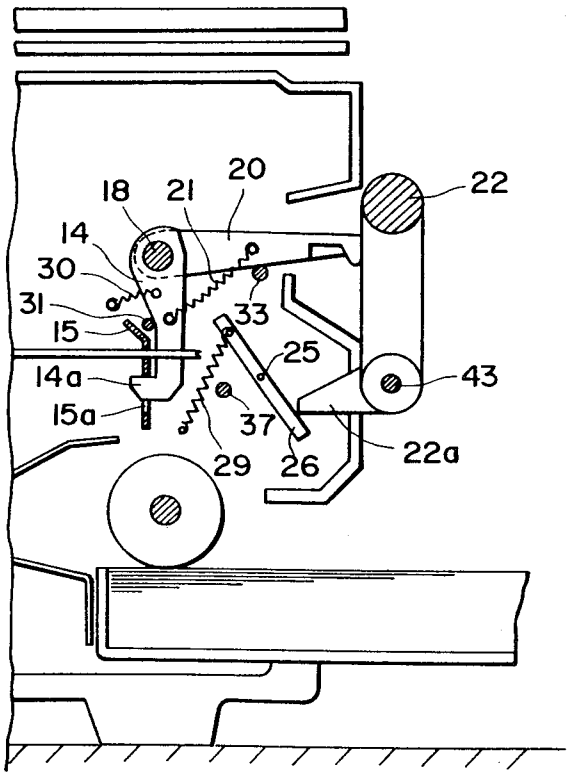
FIG. 10A is a sectional view of a major part of a copying machine according to a further embodiment of the present invention.

FIGS. 10A and 10B illustrate a further embodiment of the present invention wherein a grip is the part of the machine for shifting the locking member. Since this embodiment is similar to the embodiment of FIG. 1 except for the portions which will be described hereinafter, the detailed explanation of the similar parts will be omitted for the sake of simplicity by assigning the same reference numerals or characters to the corresponding elements.

A grip 22 is provided in the machine, which is utilized when the machine is carried about. The grip 22 is rotatable about a shaft 43 and is folded on a side surface of the machine as shown in FIG. 10A when the machine is in the operative horizontal position. The grip 22 is provided with a projection 22*a*. The projection 22*a* acts on a rocking member 26 which is rotatable about a shaft 25 against a force of a spring 29 in the clockwise direction. When the locking member 26 is rotated in this way, it does not prevent the hook 14 from shifting from its latching position to its releasing position. When the grip is pulled up in order to carry the machine, as shown in FIG. 10B, the locking member 26 is moved away from the projection 22*a* of the grip 22 and rotates to abut the stopper 37 by the force of the spring 29. In this state, the locking member 26 prevents the hook 14 from moving, even when the opening lever 20 is operated. Therefore, the hook portion 14*a* is not disengaged from the aperture 15*a* of the plate 15. Therefore, the opening of the machine is disabled. In other words, the locking member 26 in its locking position prevents the hook 14 from shifting from its latching position to its releasing position.

Figure 11B:
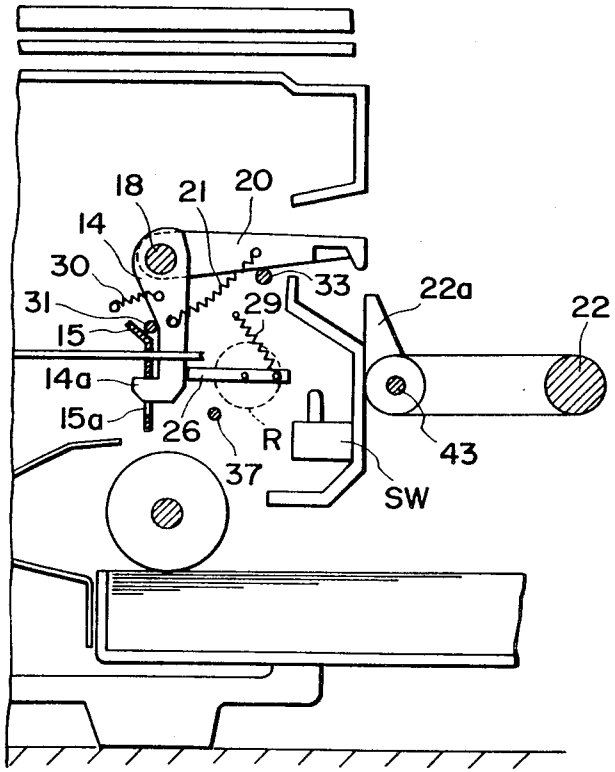
FIG. 11B is a sectional view of the copying machine of FIG. 11A wherein a grip takes a different position.
Figure 11A:
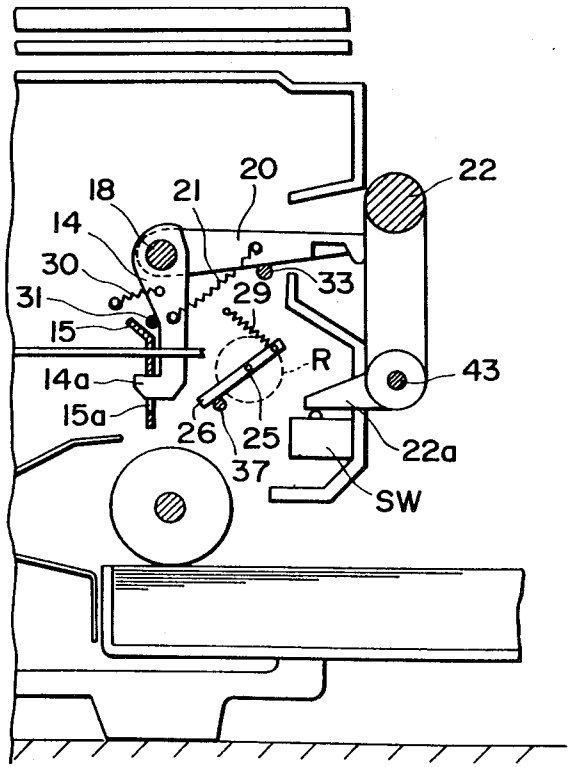
FIG. 11A is a sectional view of a major part of a copying machine according to a further embodiment of the present invention.

FIGS. 11A and 11B illustrate a further embodiment of the present invention wherein the grip is utilized for the interlocking as in the FIG. 10A embodiment. Since this embodiment is similar to the embodiment of FIG.

10A, the detailed explanation of the similar parts will be omitted for the sake of simplicity by assigning the same reference numerals or characters to the corresponding elements. FIG. 11A shows its operative state. In this embodiment, a switch SW is provided which is capable of being actuated by a projection 22*a* of the grip 22. The switch SW is in "off" state when actuated by the projection 22*a*. A rotary solenoid R is provided, which is not energized when the switch SW is "off". In this state, the locking member 26 is abutted to the stopper 37 by the force of spring 29. In this state, the locking member 26 does not interfere with the movement of the hook 14. When the grip is pulled up, the switch SW is released from the projection 22*a* of the grip 22 so as to take its "on" position, energizing a rotary solenoid R so as to rotate the locking member 26 against the force of spring 29. In this position, the locking member 26 prevents the shifting of the hook 14 from its latching position to its releasing position.

In the foregoing description of the preferred embodiments, the image forming apparatus has been shown as being an electrophotographic copying machine. However, the present invention is applicable to another type of image forming apparatus, such as a laser beam printer. The part of the apparatus for shifting the locking member has been described as a grip or tray, however, another part may be provided if the part can be moved or actuated manually. The means necessary for forming the image may be provided in both of the divisible parts, or they may be provided only in one of the parts.

As described in the foregoing, according to the present invention, when a part of the apparatus is changed from its normal state (operative state), the latching means is prevented from shifting from its latching state to its releasing state. Thus, when the apparatus is in the upright posture, or when it is carried about, the apparatus is prevented from opening erroneously. This prevents the image forming apparatus from being damaged, in a portable type image forming apparatus or an image forming apparatus which can be placed uprightly when it is not used.

While the invention has been described with reference to the structure disclosed herein, it is not confined to the details set forth and this application is intended to cover such modifications or changes as many come within the purposes of the improvements or the scope of the following claims.

What is claimed is:

1. An image forming apparatus comprising:

frame means divisible into a plurality of parts;

image forming mean provided in said frame means;

a grip for carrying said apparatus, the grip being movable between a carrying position and a retracted position;

latching means shiftable between a latching position for preventing said frame means from being divided and a releasing position for allowing the frame means to be divided, wherein when said grip is at the carrying position, said latching means is prevented from shifting from the latching position to the releasing position.

2. An apparatus according to claim 1, further comprising preventing means for limiting the shift of said latching means, said preventing means being mechanically interrelated with said grip.

3. An apparatus according to claim 1, further comprising preventing means for limiting the shift of said latching means and detecting means for detecting a position of the grips, said preventing means being responsive to said detecting means.

4. An image forming apparatus, comprising:

frame means divisible into a plurality if parts;

image forming means provided in said frame means;

a sheet guiding tray which is movable between a guiding position for guiding a sheet and a retracted position wherein it is retracted from the guiding position; and latching means shiftable between a latching position for preventing said frame from being divided and a releasing position for allowing the frame to be divided, wherein said latching means is prevented from shifting from the latching position to the releasing position when the tray is in its retracted position.

5. An apparatus according to claim 4, wherein the tray is foldable, and is switched to the retracted position from the guiding position when it is folded.

6. An apparatus according to claim 4, wherein said tray is slidable into and out of said apparatus and is switched from the guiding position to the retracted position when said tray is slid into said aparatus.

7. An apparatus according to claim 4, further comprising preventing means for limiting the shift of said latching means, said preventing means being mechanically interrelated with said tray.

8. An apparatus according to claim 4, further comprising preventing means for limiting the shift of said latching means and detecting means for detecting a position of the tray, said preventing means being responsive to said detecting means.

9. An image forming apparatus, comprising:

frame means divisible into first and second assemblies, wherein said first assembly contains a photosensitive member, and said second assembly contains feeding means for feeding a transfer material to the photosensitive member, and wherein the frame means is divisible into the first and second assemblies along a passage of the transfer material to the photosensitive member;

latching means shiftable between a latching position for preventing said frame means from being divided and a releasing position for allowing division of the frame means; and a grip for carrying the apparatus, the grip being mounted to a side surface of the apparatus, wherein said latching means is prevented from shifting from the latching position to the releasing position when said apparatus is placed with its grip facing up.

10. An image forming apparatus, comprising:

frame means divisible into first and second assemblies, wherein said first assembly contains a photosensitive member, and said second assembly contains feeding means for feeding a transfer material to the photosensitive member, and wherein the frame member is divisible into the first and second assemblies along a passage of the transfer material to the photosensitive member;

latching means shiftable between a latching position for preventing said frame means from being divided and a releasing position for allowing division of the frame means; and limiting means having an engaging portion engageable with said latching means to limit the shift of said latching means, said limiting means being rotatable about an axis between a first position wherein the engaging portion is engageable with said latching means and a second position wherein the engaging portion is away from said latching means;

wherein said limiting means assumes the second position when said apparatus is opened and assumes the first position when said apparatus is placed uprightly with its side surface down, by rotation of said limiting means by gravity about the axis.

11. An apparatus according to claim 10, wherein said limiting member has a projection at a position opposite to the engaging position, and wherein when said apparatus is operative, the limiting member assumes the second position by the weight of the projection.

12. An apparatus according to claim 10, wherein the limiting means includes a bent lever having a bent portion there the axis is located.

13. An image forming apparatus, comprising:

frame means divisible into a plurality of parts;

image forming means provided in said frame means;

latching means shiftable between a latching position for preventing said frame means from being divided and a releasing position for allowing the frame means to be divided, wherein said latching means is prevented from shifting from the latching position to the releasing position when a predetermined portion of a bottom of said apparatus is not pressed against a setting surface, whereas said latching means is allowed to shift from the latching position to the releasing position when the predetermined portion is pressed.

14. An apparatus according to claim 13, wherein the predetermined portion of the bottom of the apparatus includes a member projectable beyond the bottoms surface of the apparatus, and wherein said latching means is prevented by the projectable member being pushed.

15. An apparatus according to claim 13, further comprising a grip for carrying the apparatus mounted to the bottom.

* * * * *

UNITED STATES PATENT AND TRADEMARK OFFICE

CERTIFICATE OF CORRECTION

PATENT NO. : 4,705,384

DATED : November 10, 1987

INVENTOR(S) : MORIKAZU MIZUTANI, ET AL.

It is certified that error appears in the above-identified patent and that said Letters Patent is hereby corrected as shown below:

COLUMN 1

Line 11, "small size" should read --small-size--.
Line 13, "small size" should read --small-size--.
Line 14, "of and" should read --of space and--.
Line 34, "but in advertently" should read --and inadvertently--.

COLUMN 2

Line 4, "sectioal" should read --sectional--.
Line 46, "an" (first occurrence) should read --a--.

COLUMN 3

Line 37, "shaft 35." should read --unit 35.--.
Line 57, "unit is" should read --unit 35 is--.

COLUMN 4

Line 11, "clockwisely" should read --clockwise--.
Line 30, "uperture" should read --aperture--.

COLUMN 5

Line 21, "tray 14" should read --tray 41--.
Line 46, "stated" should be deleted.

COLUMN 6

Line 15, "no" should read --not--.
Line 48, "rocking" should read --locking--.

UNITED STATES PATENT AND TRADEMARK OFFICE

CERTIFICATE OF CORRECTION

PATENT NO. : 4,705,384

DATED : November 10, 1987

INVENTOR(S) : MORIKAZU MIZUTANI, ET AL.

It is certified that error appears in the above-identified patent and that said Letters Patent is hereby corrected as shown below:

COLUMN 7

Line 50, "apparatus comprising:" should read --apparatus, comprising:--.

Line 52, "mean" should read --means--.

COLUMN 8

Line 5, "if" should read --of--.

COLUMN 9

Line 17, "there" should read --where--.

COLUMN 10

Line 14, "bottoms" should read --bottom--.

Line 16, "prevented" should read --prevented from operating--.

Signed and Sealed this

Tenth Day of May, 1988

*Attest:*

*Attesting Officer*

DONALD J. QUIGG

*Commissioner of Patents and Trademarks*